US006019636A

United States Patent [19]

Langham

[11] Patent Number: 6,019,636

[45] Date of Patent: Feb. 1, 2000

[54] COAXIAL CABLE CONNECTOR

[75] Inventor: Arvin L. Langham, Baldwinsville, N.Y.

[73] Assignee: Eagle Comtronics, Inc., Clay, N.Y.

[21] Appl. No.: 09/175,406

[22] Filed: Oct. 20, 1998

Related U.S. Application Data

[60] Provisional application No. 60/084,322, May 5, 1998.

[51] Int. Cl.[7] ..... H01R 17/04

[52] U.S. Cl. ..... 439/584; 439/583

[58] Field of Search ..... 439/584, 583, 439/578, 585

[56] References Cited

U.S. PATENT DOCUMENTS

| | | | |
|---|---|---|---|
| 3,292,136 | 12/1966 | Somerset | 439/584 |
| 3,526,871 | 9/1970 | Hobart | 439/584 |
| 3,671,926 | 6/1972 | Nepovin | 439/584 |
| 3,686,623 | 8/1972 | Nijman | 439/584 |
| 3,706,956 | 12/1972 | Blanchenot | 439/584 |
| 3,846,738 | 11/1974 | Nepovim | 439/584 |
| 3,854,789 | 12/1974 | Kaplan | 439/584 |
| 4,346,958 | 8/1982 | Blanchard | 439/584 |
| 4,447,107 | 5/1984 | Major, Jr. et al. | 439/584 |
| 4,557,546 | 12/1985 | Dreyer | 439/584 |
| 4,575,274 | 3/1986 | Hayward | 439/584 |
| 4,676,577 | 6/1987 | Szegda | 439/584 |
| 4,854,893 | 8/1989 | Morris | 439/578 |
| 5,259,790 | 11/1993 | Hayward | 439/578 |
| 5,651,698 | 7/1997 | Locati et al. | 439/584 |
| 5,785,554 | 7/1998 | Ohshiro | 439/584 |

*Primary Examiner*—Paula Bradley
*Assistant Examiner*—Tho D. Ta
*Attorney, Agent, or Firm*—Parkhurst & Wendell, L.L.P.

[57] ABSTRACT

Two-piece and three-piece coaxial cable connectors having common components. Both structures include a connector assembly having first and second sets of circumferential threads, a contact, supported inside the connector assembly via an insulator, having a receiving element and extending from a front end of the assembly, and a collet, retained in a rear end of the assembly, having a ramp surface corresponding to a chamfer of the receiving element. Both structures also include a rear nut assembly that includes a pair of grips that are radially outwardly biased toward an inside surface of the rear nut assembly, which grips cooperate with a sleeve to grip an outer sheath of a coaxial cable and permit unfettered insertion and removal of a coaxial cable end. In the two-piece structure the sleeve is retained inside the rear nut assembly. In the three-piece structure, the sleeve is part of a center nut assembly.

43 Claims, 6 Drawing Sheets

COAXIAL CABLE CONNECTOR

CROSS-REFERENCE TO RELATED APPLICATION

This application claims the benefit of the May 5, 1998 filing date of U.S. Provisional Patent Application Ser. No. 60/084,322 filed May 5, 1998.

BACKGROUND OF THE INVENTION

The present invention is directed to coaxial cable connectors and, in particular, to coaxial cable connectors having a modular design whereby a two or three-piece connector can be implemented.

Coaxial cable is constructed with a center conductor surrounded by a dielectric material and air-housed in a metallic sheath. The relationship between the center conductor, dielectric, air and sheath determines the cable's characteristic impedance and its electromagnetic signal carrying performance.

In community antenna television (CATV), also known as cable television, coaxial cable is widely used and connected to various types of equipment using differently sized connectors, depending on the particular circumstances. For example, connectors are needed for trunk and distribution lines in a cable system. Typically, such cable lines have a characteristic impedance of 75 Ohms, and thus any connector used for terminating such trunk or distribution lines have a similar impedance value. Generally, a coaxial cable connector terminates both the center conductor and outer conductor (sheath) of the coaxial cable without damaging those components with the termination mechanism.

There are numerous known cable connectors. For example, Morris U.S. Pat. No. 4,854,893 discloses a coaxial cable connector having a ferrule 36 that "floats" within a housing 28 to permit the ferrule to accommodate receiving a seamed sheath of a cable, a somewhat distorted or deformed sheath of a cable or a noncircular sheath of a cable. However, even with such a "floating" ferrule arrangement, the sheath of a coaxial cable will contact the ferrule upon cable insertion into and cable removal from the connector. That is, ferrule 36 will almost always make contact with sheath of a cable during insertion and removal. Accordingly, unfettered insertion and removal of a cable is not possible with a structure like that disclosed by Morris.

Other cable connectors include sheath gripping mechanisms that include a gripping ferrule having a ramped surface at one end only thereof, whereby unbalanced gripping occurs. Blanchenot U.S. Pat. No. 3,706,958 and Nepovim U.S. Pat. No. 3,846,738 are examples of such mechanisms.

Since connectors are often attached to and removed from ends of coaxial cables in the field, a connector that provides simple and consistent connection is desirable. Furthermore, some field workers are familiar with connectors having a two-piece design while others are more comfortable using a three-piece design. Accordingly, it would be advantageous to have a coaxial cable connector that provides a superior gripping mechanism that can be implemented in either a two or three-piece connector structure.

SUMMARY OF THE INVENTION

It is therefore an object of the present invention to provide a modular cable connector that can be implemented as either a two or three-piece device, wherein the three-piece device uses components common to the two-piece device. With the present invention, it is possible to manufacture, at low cost, a two or three-piece coaxial cable connector, each being readily useable by coaxial cable installers.

It is a further object of the present invention to provide a unique gripping and release mechanism for the outer conductor, or sheath, of a coaxial cable.

It is still a further object of the present invention to provide a gripping mechanism that springs open to allow unfettered entry and removal of a coaxial cable from the connector and which provides even and balanced separation.

Another object of the present invention is to provide a collet that pulls away from a contact during an un-mating sequence.

Yet another object of the present invention is to provide a coaxial cable connector that has an anti-rotation construction such that a coaxial cable is not rotated during a mating sequence.

To achieve the above and other objects, a first embodiment of the present invention, a two-piece structure, provides a coaxial cable connector comprising a connector assembly having a first set of threads at a front end thereof and second set of threads at a rear end thereof. A contact has an end extending from the front end and has a receiving portion at an opposite end thereof. The receiving portion includes a chamfer on an outer circumferential portion and the contact is supported inside the connector assembly via an insulator. A collet, retained in the rear end of the connector assembly, has a ramp surface corresponding to the chamfer of the receiving portion.

A rear nut assembly is threadably attachable to the second set of threads of the connector assembly and has a retainer and sleeve. The sleeve has an outer diameter less than an inner diameter of an outer sheath of a coaxial cable and is open at both ends for passing therethrough a center conductor of a coaxial cable.

A means in cooperation with the sleeve for gripping the outer sheath of a coaxial cable is also provided. The means for gripping includes a pair of symmetrical grips that are opposed to each other and surround the sleeve. The grips are biased against an inside surface of the rear nut assembly, preferably by a snap ring.

According to a second embodiment of the present invention, a three-piece structure, there is provided a coaxial cable connector comprising a connector assembly like that of the first embodiment. In addition there is provided a center nut assembly having a sleeve with an outer diameter less than an inner diameter of an outer sheath of a coaxial cable and being open at both ends for passing therethrough a center conductor of a coaxial cable. The center nut assembly has inner and outer threads, the inner threads being threadably attachable to the second set of threads of the connector assembly. A rear nut assembly of the second embodiment is threadably attachable to the outer threads of the center nut assembly, and has a retainer and a means for gripping the outer sheath of a coaxial cable like that of the first embodiment.

Since a substantial number of the components comprising the two different embodiments are identical, the two- and three-piece embodiments can be manufactured with reduced costs.

Further in accordance with the present invention, when the outer sheath of a coaxial cable slides onto the sleeve and the center conductor of the same coaxial cable passes through the sleeve and is received by the receiving portion of the contact, and the rear nut assembly is threadably attached to the connector assembly (first embodiment), the retainer causes the collet to move in an axial direction toward the connector assembly whereby the ramp surface forcibly inwardly compresses the receiving portion via the chamfer thereby grasping the inner conductor, and thereafter, the outer sheath is gripped between the grips and the sleeve. In the second embodiment, this sequence is replaced by first threadably attaching the center nut assembly to the connector assembly making connection with the center conductor of a coaxial cable, and thereafter, the rear nut assembly is threadably attached to initiate the outer sheath gripping.

These and other objects of the present invention will become apparent to those skilled in the art as the description thereof proceeds.

BRIEF DESCRIPTION OF THE DRAWINGS

The features that are considered characteristic of this invention are stated with particularity in the appended claims. The invention will be more fully understood from the following description when read in conjunction with the accompanying drawings, wherein:

DETAILED DESCRIPTION OF THE INVENTION

Figure 1:
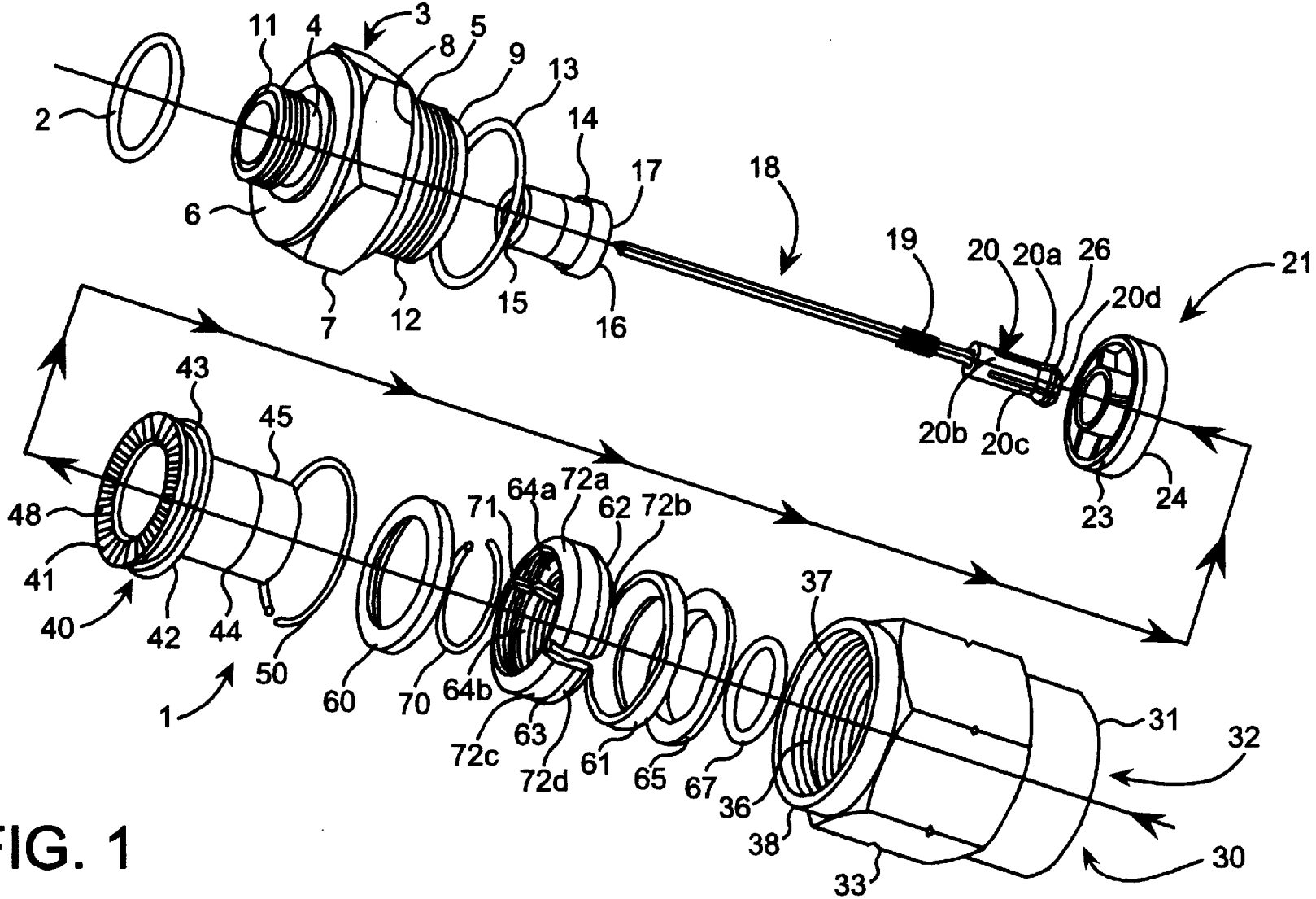
FIG. 1 is an exploded view of a first embodiment of the present invention.

A first embodiment of the coaxial cable connector according to the present invention is described with reference to FIGS. 1 and 2. The first embodiment of the present invention is shown, generally, by 1 and comprises two main sections, namely, connector assembly 3 and rear nut assembly 30.

Connector assembly 3 is typically made from a conductive material such as aluminum, and includes a front face 6, nut pattern 7, axial end surface 8, and a contacting surface 9 which is spaced from axial end surface 8 in an axial direction of the connector assembly 3. Threads 12 form the outer surface of the connector assembly 3 between axial end surface 8 and contacting surface 9. Threads 11 are provided on a front end of the connector assembly 3 for connecting the connector assembly 3 to a desired piece of equipment. O-rings 2, 13 are preferably disposed around the connector assembly in corresponding grooves 4, 5.

Figure 2:
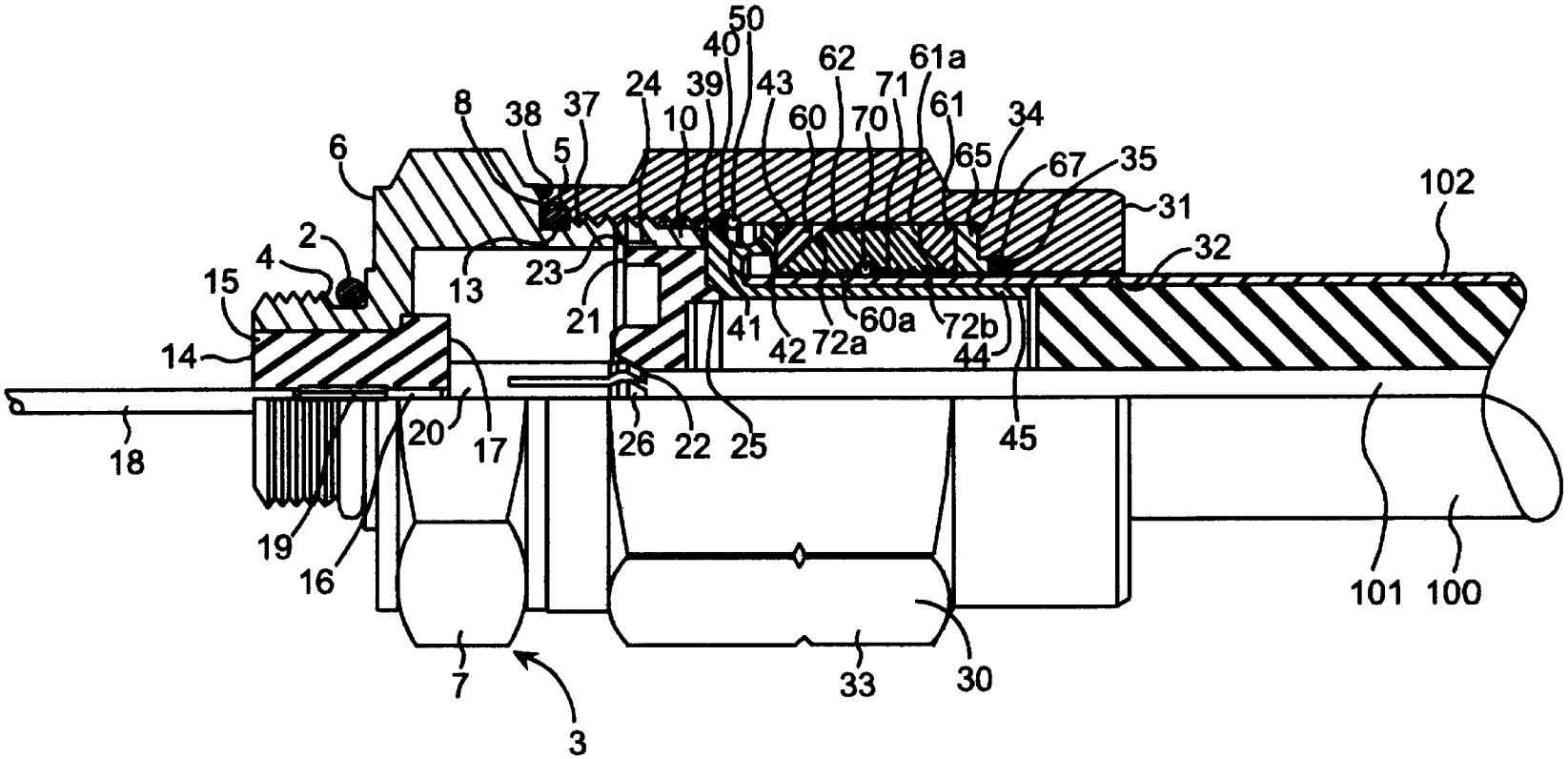
FIG. 2 is a partial cross-sectional view of the first embodiment in a mated configuration.

As shown only in FIG. 2, connector assembly 3 also includes a radially inward projection that provides a stop surface 10 whose function is explained herein.

The connector assembly 3 further includes an insulator 14 having a front face 15 that is exposed at a front end of the connector assembly 3. Preferably, front face 15 has a conical angle of about 5 degrees so that water does not accumulate thereon. Axis bore 16 extends through the insulator 14 and receives cable a contact 18. Contact 18 includes a straight knurl 19 that is embedded inside bore 16 of insulator 14. Contact 18 is inserted through the insulator until a receptor 20 abuts end surface 17 of insulator 14. Receptor 20 is axially slit into a plurality of beams 20*a–d* for receiving an inner conductor of a coaxial cable, as described in more detail herein. Each of the beams 20*a–d* includes a chamfer 26.

The last piece of the connector assembly 3 is a collet 21. The collet includes a ramp surface 22 that cooperates with the chamfer 26 of the beams 20*a–d*. Collet 21 also includes a ramp surface 23 and stop 24. The collet 21 is inserted into the connector assembly 3 whereby ramp 23 causes the collet to contract radially to fit into a cavity of the connector assembly 3. The collet 21 is then captured within connector assembly 3 due to stop 24 that abuts stop 10 of connector assembly 3. This is shown in FIG. 2. Collet 21 also includes a protrusion 25 as explained later herein.

The second section of the first embodiment of the present invention is rear nut assembly 30. Rear nut assembly 30, also made from electrically conductive material, includes a rear end 31, and has axial bore 32 that extends through the entire assembly 30. The rear nut assembly 30 includes a nut pattern 33 on its exterior and an interior peripheral surface thereof has a stepped structure 34, 35 which accommodates other assembly parts as discussed herein. A front end of rear nut assembly 30 includes internal threads 36 complementary to threads 12 of the connector assembly 3. An internal annular groove 39 is also provided. Between the internal threads 36 and an axial end surface 38, an annular groove 37 is provided.

As shown in FIGS. 1 and 2, a retainer with sleeve 40 is held inside rear nut assembly 30 by a snap ring 50 lodged in internal annular groove 39 thereby capturing the retainer with sleeve 40 via annular groove 41. The retainer has front face 42 and back face 43 and is connected with sleeve 44. Around sleeve 44 are axially disposed, in the following order, ferrule 60 having ramp 60*a*, grips 62, 63 each having, respectively, an annular groove 64*a*, 64*b*, another ferrule 61 having a ramp 61*a*, thrust washer 65 and O-ring 67. Ferrules 60, 61 are identical, and merely face in opposite directions. The thrust washer 65 and O-ring 67 fit in stepped structure 34/35 of rear nut assembly 30. A snap ring or C-ring 70 fits in annular grooves 64*a* and 64*b* of grips 62, 63 to bias the grips away from sleeve 44. Grips 62, 63 include ridges 71 on the inside surface thereof and chamfered sides 72*a*–72*d*. Chamfered sides 72*a*–72*d* interact with ramps 60*a* and 61*a* of ferrules 60, 61. Grips 62, 63 are preferably identical and symmetrical for reduced manufacturing cost.

Sleeve 44 preferably has a tapered section 45. Furthermore, retainer with sleeve 40 preferably includes a face knurl 48 on front face 41. While retainer with sleeve 40 is shown as an integral unit, this element can be separated into separate retainer and sleeve portions.

The interaction of the various parts described thus far when mating the connector assembly 3 with the rear nut assembly 30 to terminate a coaxial cable, will now be described.

The end of a coaxial cable 100 is prepared such that the center conductor 101 extends beyond the outer sheath 102 of the cable 100. Any dielectric material disposed between the center conductor 101 and outer sheath 102 in the vicinity of the end of the cable 100 is removed. Such cable preparation is well-known in the art. The center conductor 101 is cut such that when the cable 100 is inserted into the rear end 31 of the rear nut assembly 30, the center conductor 101 extends into receptor 20 of contact 18. Sleeve 44 has an outer diameter that is smaller than the inner diameter of the outer sheath 102 of the cable 100 such that the outer sheath 102 slips over the sleeve 44. Tapered section 45 facilitates this procedure. Also, cable 100 is inserted into the rear end 31 until an end portion of the outer sheath abuts a stop portion on retainer with sleeve 40. As the rear nut assembly 30 is threaded onto connector assembly 3, the front face 42 of the retainer with sleeve 40 abuts collet 21 and pushes ramp surface 22 up onto chamfer 26 of each of beams 20*a*–20*d*, thereby forcing beams 20*a*–20*d* to grip center conductor 101, making mechanical and electrical contact therewith.

Figure 2A:
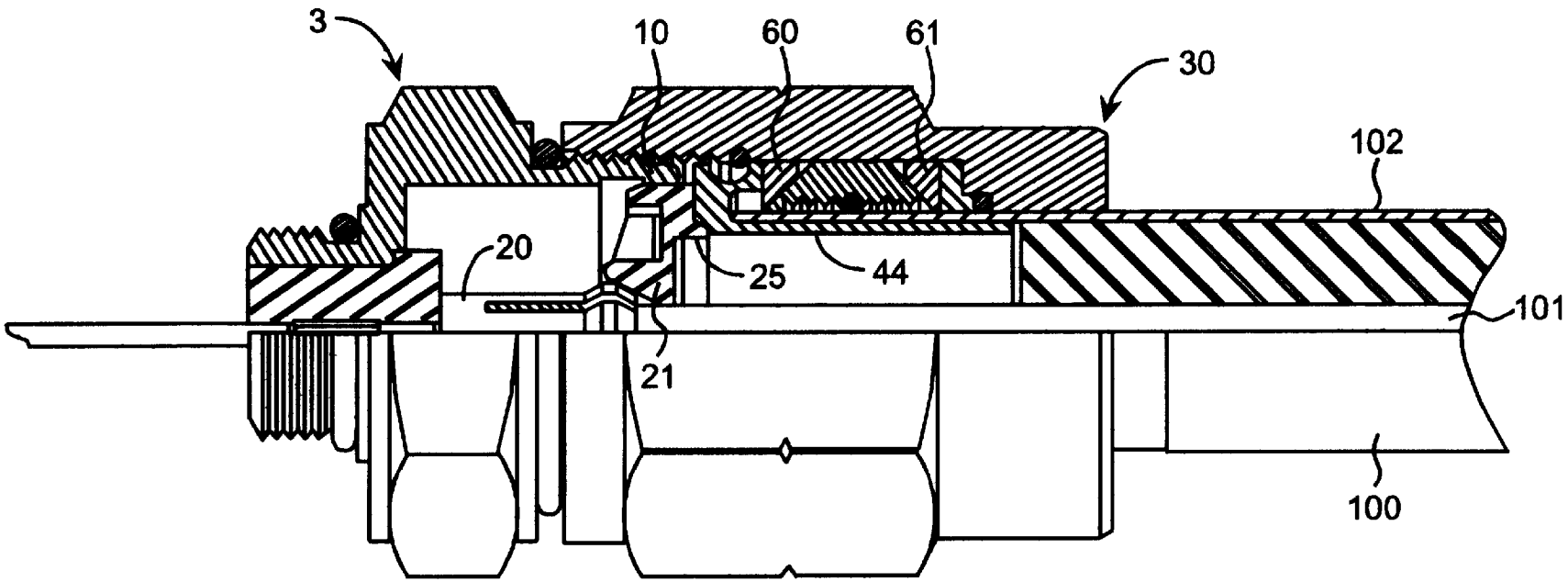
FIG. 2A is a partial cross-sectional view of the first embodiment, similar to FIG. 2, except that the connector is here shown in a less than mated position.

As seen in FIGS. 2 and 2A, protrusion 25 is press fitted into an open end of front face 42 of retainer with sleeve 40. Thus, when the rear nut assembly and connector assembly 3 are un-mated, the collet 21 is first pulled off receptor 20 and then is prevented from separating from connector assembly 3 due to the interaction between stop 24 and corresponding stop 10.

Returning now to the mating sequence, as rear nut assembly 30 is further threaded onto connector assembly 3, back face 43 of retainer 40 and thrust washer 65 force ferrules 60, 61 to move toward each other. This approaching movement, due to the corresponding ramps on the ferrules and ramps 72*a*–72*d*, forces grips 62, 63 to move radially inwardly, thereby sandwiching outer sheath 102 between grips 62, 63 and sleeve 44. Compare FIGS. 2A and 2, respectively. FIG. 2A shows the elements before being completely tightened as shown in FIG. 2. This gripping action provides both mechanical and electrical connection between the conductor 101 and contact 18. Ridges 71 ensure such a positive connection.

When the rear nut assembly is un-mated from the connector assembly 3, the ferrules no longer are forced to approach each other and snap ring 70 forces grips 62, 63 apart thereby loosening the outer sheath 102 for removal.

O-rings 13 and 67 provide watertight junctions between, respectively, connector assembly 3 and rear nut assembly 30 and outer sheath 102 and rear nut assembly 30.

In accordance with the structure of the present invention, when the connector assembly 3 is mated with the rear nut assembly 30, the center conductor 101 of a coaxial cable is first joined mechanically and electrically to contact 18 and only thereafter is outer sheath 102 gripped between sleeve 44 and grips 62, 63. The just-described feature provides an anti-rotation function whereby the coaxial cable 100 is not rotated during the mating sequence. That is, the dimensions of the various parts of the connector are such that gripping of sheath 102 does not take place until the connector assembly 3 and rear nut assembly 30 are almost fully mated. This is made possible by, for example, the width of annular groove 41 and position of snap ring 50 as well as the distance between axial end surface 38 and stepped structure 34, 35 of the rear nut assembly 30.

Furthermore, the structure of the present invention provides, when un-mating, the same anti-rotation function. That is, since the grips 62, 63 are first moved away from outer sheath 102, via snap spring 70, coaxial cable 100 is not rotated. Likewise, because the grips 62, 63 are moved radially outwardly, cable entry and removal are facilitated. The tapered section 45 of sleeve 44 further facilitates removal of a coaxial cable.

Further still, because the collet 21 becomes press fitted into the front face of retainer 40, the center conductor 101 is released easily once the rear nut assembly 30 is unthreaded from connector assembly 3.

Figure 3:
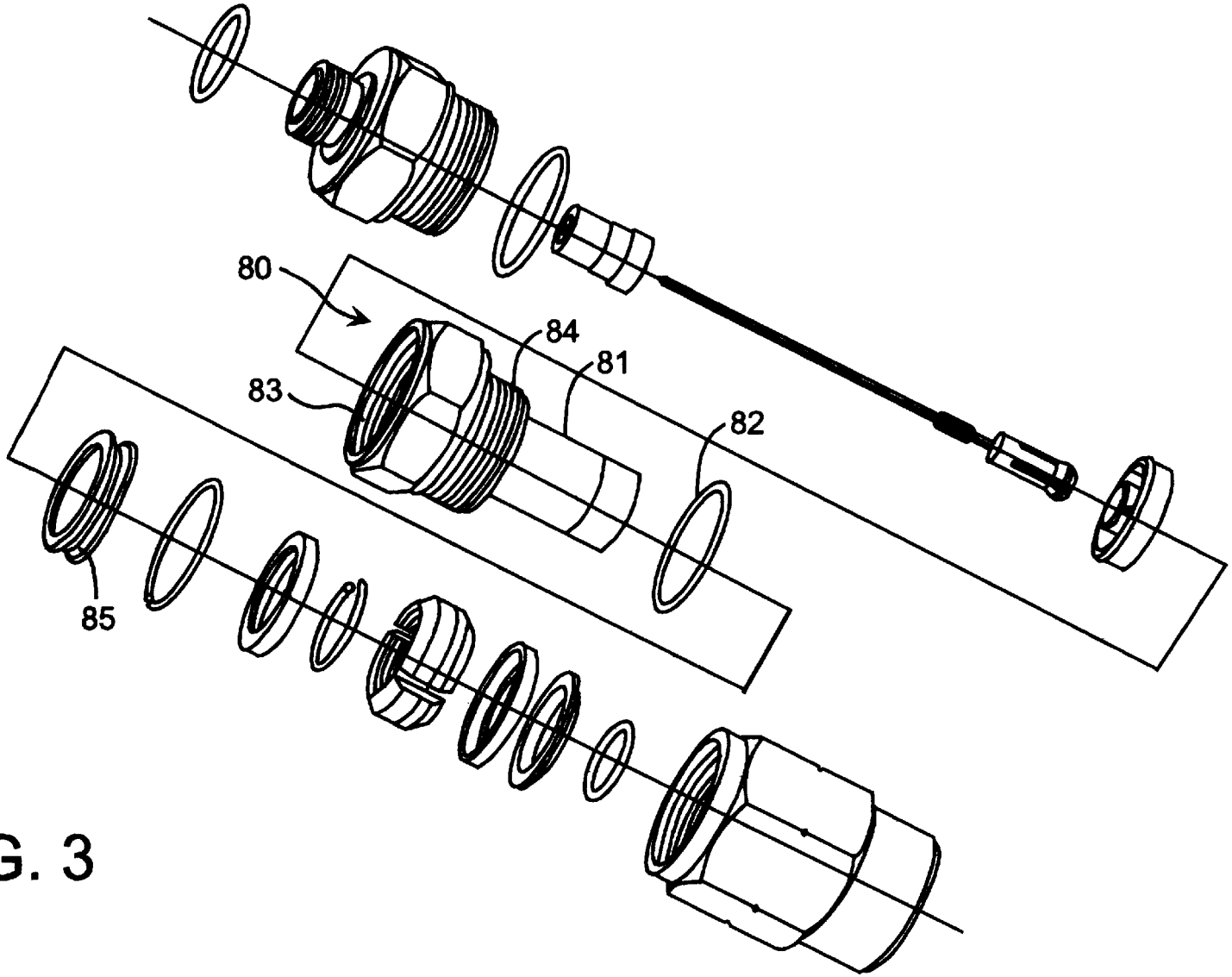
FIG. 3 is an exploded view of a second embodiment of the present invention.
Figure 4:
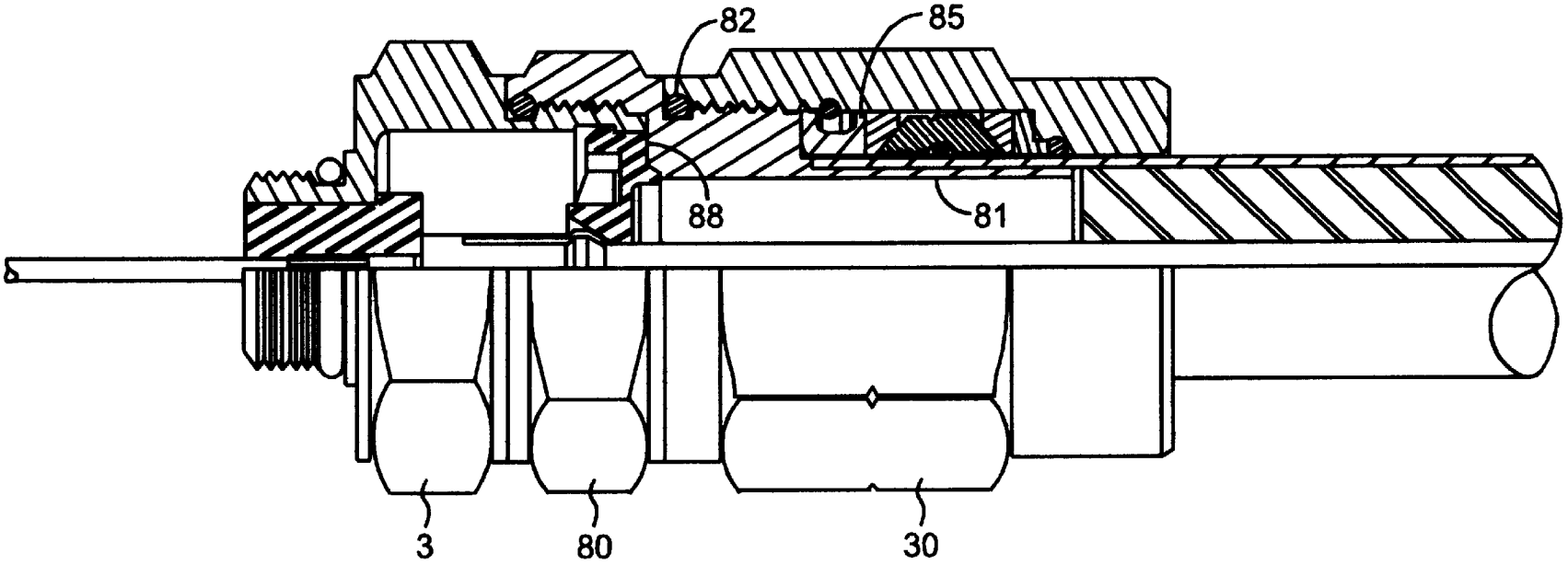
FIG. 4 is a partial cross-sectional view of the second embodiment in a mated configuration.
Figure 4A:
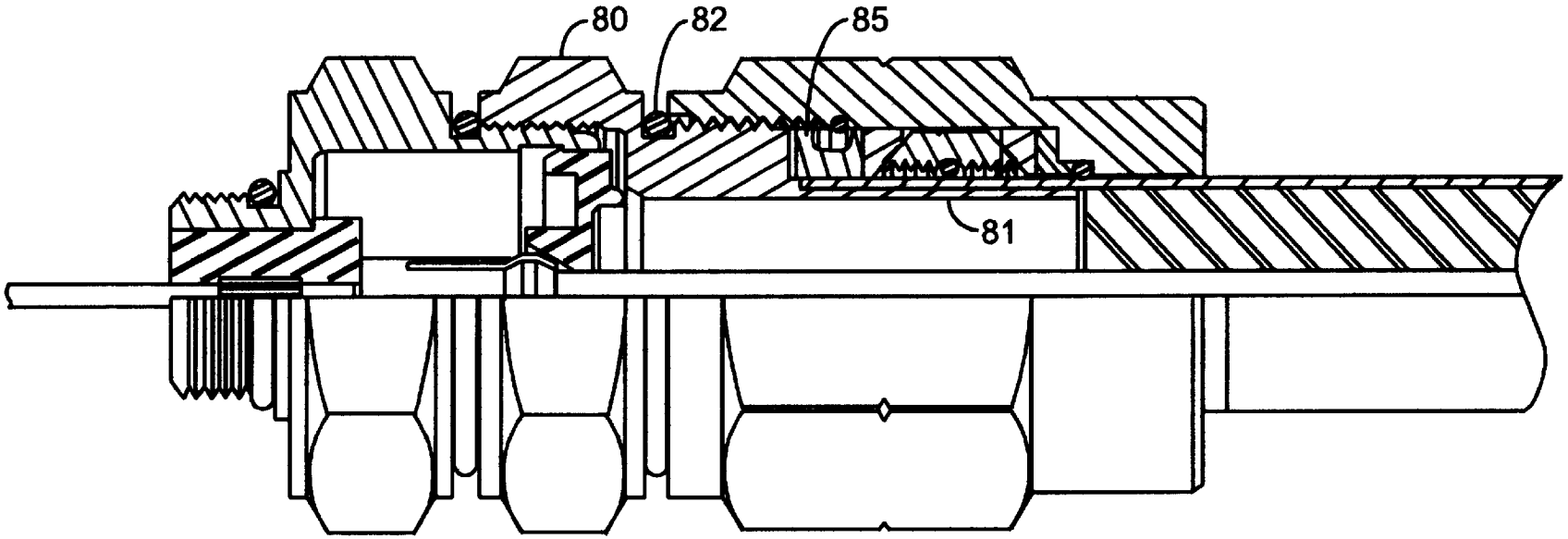
FIG. 4A is a partial cross-sectional view of the first embodiment, similar to FIG. 4, except that the connector is here shown in a less than mated position.

A second embodiment of the present invention is depicted in FIGS. 3, 4 and 4A. Elements of FIGS. 3, 4 and 4A that correspond to elements depicted in FIGS. 1 and 2 have identical reference numerals.

As shown in FIGS. 3, 4 and 4A, the main difference between the first embodiment and the second embodiment of the present invention is that the second embodiment includes a center nut 80 having an integral sleeve 81. A separate retainer 85 is also provided. The center nut 80 includes inner threads 83 that correspond with threads 12 of the connector assembly 3 and outer threads 84 that correspond with inner threads 36 of the rear nut assembly 30. An O-ring 82 is provided between the junction of center nut 80 and rear nut assembly 30. Retainer 85 is maintained in proper position inside rear nut assembly 30 via a similar internal annular groove 39 and snap ring 50 structure, as in the first embodiment.

In accordance with the second embodiment of the present invention, the rear nut assembly 30 is slipped over the cut end of a coaxial cable and the outer sheath 102 of the cable is slipped over sleeve 81. Outer sheath 102 of the coaxial cable 100, once fully inserted, abuts a portion of the center nut 80, rather than retainer 85 as in the first embodiment. Center nut 80 is then threaded onto connector assembly 3, and front face 88 of center nut 80 makes contact with collet 21 in a fashion similar to that whereby retainer with sleeve 40 of the first embodiment makes contact therewith. Then, rear nut assembly 30 is threaded onto outer threads 84 of center nut 80 whereby the gripping function of grips 62, 63 is effected. O-ring 82 provides a watertight seal between center nut 80 and rear nut assembly 30.

In accordance with the second embodiment of the present invention, a three-piece connector further ensures that the center conductor 101 of a coaxial cable 100 will first be mechanically and electrically joined. The third piece, i.e., rear nut assembly 30, is then mated with the center nut 80 whereby the outer sheath 102 of the coaxial cable is electrically and mechanically joined via the unique spring-loaded gripping mechanism of the present invention.

Significantly, both embodiments of the present invention utilize many very similar or even identical elements. Accordingly, it is relatively inexpensive to manufacture both types of connectors. That is, the only difference between the elements of the first and second embodiments is the addition in the second embodiment of center nut 80/sleeve 81, O-ring 82 and separate retainer 85. Otherwise, all elements may be identical so that common manufacturing of parts is possible and a modular coaxial cable connector design is provided.

Also, when either embodiment is fully mated, the structure is not only water/weather-tight, but, due to metal-to-metal contact, also prevents undesirable ingress or egress of electrical, radio frequency interference (RFI) or electromagnetic interference (EMI) energy.

Although particular embodiments of the invention have been described and illustrated herein, it is recognized that modifications and variations may readily occur to those skilled in the art. It is intended that the claims be interpreted to cover such modifications and variations.

What is claimed is:

1. A coaxial cable connector, comprising:

a connector assembly comprising:

a first set of circumferential threads at a front end thereof and second set of circumferential threads at a rear end thereof, a contact having an end extending from said front end and having a receiving element at an opposite end thereof, said receiving element including a chamfer on an outer circumferential portion thereof, said contact being supported inside said connector assembly via an insulator;

a collet, retained in said rear end of said connector assembly, having a ramp surface corresponding to said chamfer of said receiving element; and a rear nut assembly, threadably attachable to said second set of threads of said connector assembly, said rear nut assembly comprises:

a retainer and sleeve, said sleeve having an outer diameter less than an inner diameter of an outer sheath of a coaxial cable and open at both ends for passing therethrough a center conductor of the coaxial cable; and a pair of grips in cooperation with said sleeve for gripping the outer sheath of the coaxial cable, said grips opposed to each other and surrounding said sleeve, a spring biasing said grips radially outwardly against an inside surface of said rear nut assembly.

2. The connector of claim 1, wherein said spring is a C-ring.

3. The connector of claim 1, further comprising at least one O-ring.

4. The connector of claim 1, wherein said spring is a C-ring, said C-ring disposed in an annular groove in the rear nut assembly for holding said retainer.

5. The connector of claim 1, wherein said contact includes a portion, embedded in said insulator, having a straight knurl.

6. The connector of claim 1, wherein said receiving element of said contact is longitudinally slit to comprise a pluarality of beams.

7. The connector of claim 1, wherein said collet is comprised of plastic.

8. The connector of claim 1, wherein said collet comprises, on an outer peripheral portion thereof, a ramp and a stop portion, said stop portion cooperating with a corresponding inner circumferential stop portion of said connector assembly.

9. The connector of claim 1, wherein said sleeve is tapered at one end thereof.

10. The connector of claim 1, wherein an exposed face of said insulator comprises a conical surface.

11. The connector of claim 1, wherein a face of said retainer that abuts said collet includes a face knurl.

12. The connector of claim 1, wherein, when said rear nut assembly is threadably attached to said connector assembly, the combined assembly is substantially waterproof and prevents leakage of at least one of electrical, electromagnetic interference (EMI) and radio frequency interference (RFI) energy.

13. The connector of claim 1, wherein an end portion of the outer sheath of the coaxial cable abuts the retainer.

14. The connector of claim 1, wherein each of the pair of grips is symmetrical with the other.

15. The connector of claim 1, wherein said pair of grips comprises an inclined surface and at least one ferrule having a corresponding inclined surface, so that when said rear nut assembly is threadably attached to said connector assembly, said at least one ferrule forces said inclined surface radially inwardly.

16. The connector of claim 15, wherein said at least one ferrule, when said rear nut assembly is threadably attached to said connector assembly, abuts at least one of said retainer and an inner end portion of said rear nut assembly.

17. The connector of claim 15, wherein the connector includes two ferrules.

18. The connector of claim 17, wherein a thrust washer is disposed between one of said ferrules and said inner end portion of said rear nut assembly.

19. The connector of claim 1, wherein, when the outer sheath of the coaxial cable surrounds said sleeve and the center conductor of the same coaxial cable passes through said sleeve and is received by said receiving element of said contact and said rear nut assembly is threadably attached to said connector assembly, said retainer forces said collet in an axial direction toward said connector assembly whereby said ramp surface forcibly inwardly compresses said receiving portion via said chamfer thereby grasping the inner conductor, and the outer sheath is gripped between said means for gripping and said sleeve.

20. The connector of claim 19, wherein, when said rear nut assembly is threadably attached to said connector assembly, said collet is press fitted into at least one of said retainer and sleeve.

21. A coaxial cable connector, comprising:

a connector assembly comprising:

a first set of circumferential threads at a front end thereof and second set of circumferential threads at a rear end thereof, a contact extending from said front end and having a receiving element at an opposite end thereof, said receiving element including a chamfer on an outer circumferential portion thereof, said contact being supported inside said connector assembly via an insulator, and a collet, retained in said rear end of said connector assembly, having a ramp surface corresponding to said chamfer of said receiving element;

a center nut assembly comprises:

a sleeve having an outer diameter less than an inner diameter of an outer sheath of a coaxial cable and open at both ends for passing therethrough a center conductor of the coaxial cable; and inner and outer circumferential threads, said inner threads being threadably attachable to said second set of threads of said connector assembly; and a rear nut assembly, threadably attachable to said outer threads of said center nut assembly, said rear nut assembly comprises:

a retainer, and a pair of grips in cooperation with said sleeve for gripping the outer sheath of the coaxial cable, said grips opposed to each other and surrounding said sleeve, a spring biasing said grips outwardly against an inside surface of said rear nut assembly.

22. The connector of claim 21, wherein said spring is a C-ring.

23. The connector of claim 21, further comprising at least one O-ring.

24. The connector of claim 21, wherein said spring is a C-ring, said C-ring disposed in an annular groove in the rear nut assembly for holding said retainer.

25. The connector of claim 21, wherein said contact includes a portion, embedded in said insulator, having a straight knurl.

26. The connector of claim 21, wherein said receiving element of said contact is longitudinally slit to comprise a plurality of beams.

27. The connector of claim 21, wherein said collet is comprised of plastic.

28. The connector of claim 21, wherein said collet comprises, on an outer peripheral portion thereof, a ramp and a stop portion, said stop portion cooperating with a corresponding inner circumferential stop portion of said center nut assembly.

29. The connector of claim 21, wherein said sleeve is tapered at one end thereof.

30. The connector of claim 21, wherein an exposed face of said insulator comprises a conical surface.

31. The connector of claim 21, wherein, when said center nut assembly is threadably attached to the connector assembly and said rear nut assembly is threadably attached to said center nut assembly, the combined assembly is substantially waterproof and prevents leakage of at least one of electrical, EMI and RFI energy.

32. The connector of claim 21, wherein an end portion of the outer sheath of the coaxial cable abuts a portion of the center nut.

33. The connector of claim 21, wherein each of the pair of grips is symmetrical with the other.

34. The connector of claim 21, wherein said pair of grips comprises an inclined surface and at least one ferrule having a corresponding inclined surface, so that when said rear nut assembly is threadably attached to said connector assembly, said at least one ferrule forces said inclined surface radially inwardly.

35. The connector of claim 34, wherein said at least one ferrule, when said rear nut assembly is threadably attached to said connector assembly, abuts at least one of said retainer and an inner end portion of said rear nut assembly.

36. The connector of claim 34, wherein the connector includes two ferrules.

37. The connector of claim 36, wherein a thrust washer is disposed between one of said ferrules and said inner end portion of said rear nut assembly.

38. The connector of claim 21, wherein, when an inner conductor of the coaxial cable is received in said receiving element and said center nut assembly is threadably attached to said connector assembly, said center nut assembly forces said collet in an axial direction toward said connector assembly whereby said ramp surface forcibly inwardly compresses said receiving element via said chamfer thereby grasping said inner conductor, and when said rear nut assembly is threadably attached to said center nut assembly, said outer sheath is gripped between said pair of grips and said sleeve.

39. The connector of claim 38, wherein, when said center nut assembly is threadably attached to said connector assembly, said collet is press fitted into at least one of said retainer and sleeve.

40. A coaxial cable connector, comprising:

a connector assembly comprising:

a first set of circumferential threads at a front end thereof and second set of circumferential threads at a rear end thereof, a contact extending from said front end and having a receiving element at an opposite end thereof, said receiving element including a chamfer on an outer circumferential portion thereof, said contact being supported inside said connector assembly via an insulator, and a collet, retained in said rear end of said connector assembly, having a ramp surface corresponding to said chamfer of said receiving element; and a means for gripping the outer sheath of a coaxial cable having:

a sleeve having an outer diameter less than an inner diameter of an outer sheath of the coaxial cable and open at both ends for passing therethrough a center conductor of the coaxial cable; and a retainer, at least a portion of said means for gripping being threadably attachable to said second set of threads of said connector assembly; said means for gripping including a pair of grips opposed to each other and surrounding said sleeve, a spring biasing said grips radially outwardly against an inside surface of said rear nut assembly.

41. The connector of claim 40, wherein, when the center conductor of a coaxial cable is received in said receiving element of said contact and said means for gripping is threadably attached to said connector assembly, said collet is forced in an axial direction toward said connector assembly whereby said ramp surface forcibly inwardly compresses said receiving element via said chamfer thereby grasping said inner conductor, and the outer sheath of the same coaxial cable is gripped between said means for gripping and said sleeve.

42. The connector of claim 40, wherein said means for gripping comprises a single assembly threadably attachable onto said second set of threads of said connector assembly.

43. The connector of claim 40, wherein said means for gripping comprises two separate assemblies including a center nut assembly and a rear nut assembly, wherein said center nut assembly includes said sleeve, is threadably attachable to said connector assembly and axially forces said collet, and said rear nut assembly houses said grips, is threadably attachable to said center nut assembly for causing the outer sheath to be gripped between said grips and said sleeve.

* * * * *